US010584610B2

(12) United States Patent
Hoffman et al.

(10) Patent No.: US 10,584,610 B2
(45) Date of Patent: Mar. 10, 2020

(54) COMBUSTION DYNAMICS MITIGATION SYSTEM

(71) Applicant: General Electric Company, Schenectady, NY (US)

(72) Inventors: Seth Reynolds Hoffman, Spartanburg, SC (US); Lucas John Stoia, Taylors, SC (US); Sven Georg Bethke, Greenville, SC (US); Richard Martin DiCintio, Simpsonville, SC (US); Jeffrey Scott LeBegue, Greer, SC (US); Jayaprakash Natarajan, Greer, SC (US)

(73) Assignee: General Electric Company, Schenectady, NY (US)

( * ) Notice: Subject to any disclaimer, the term of this patent is extended or adjusted under 35 U.S.C. 154(b) by 597 days.

(21) Appl. No.: 15/292,452

(22) Filed: Oct. 13, 2016

(65) Prior Publication Data

US 2018/0106163 A1 Apr. 19, 2018

(51) Int. Cl.

| | |
|---|---|
| ***F01D 25/04*** | (2006.01) |
| ***F23M 20/00*** | (2014.01) |
| ***F23R 3/00*** | (2006.01) |
| ***F23R 3/10*** | (2006.01) |
| ***F23R 3/28*** | (2006.01) |
| ***F23R 3/44*** | (2006.01) |

(52) U.S. Cl.

CPC ..... *F01D 25/04* (2013.01); *F23M 20/005* (2015.01); *F23R 3/002* (2013.01); *F23R 3/10* (2013.01);

(Continued)

(58) Field of Classification Search

CPC ..... F23R 2900/00014; F23R 3/002; F23M 20/005; F05D 2260/963; F05D 2270/14;

(Continued)

(56) References Cited

U.S. PATENT DOCUMENTS

| | | | |
|---|---|---|---|
| 6,530,221 | B1 | 3/2003 | Sattinger et al. |
| 7,461,719 | B2 | 12/2008 | Tobik et al. |

(Continued)

FOREIGN PATENT DOCUMENTS

| | | | |
|---|---|---|---|
| EP | 2 302 302 | A2 | 3/2011 |
| WO | WO2016039725 | A1 | 3/2016 |

OTHER PUBLICATIONS

Extended European Search Report and Written Opinion issued in connection with corresponding EP Application No. 17194645.2 dated Mar. 12, 2018.

*Primary Examiner* — William H Rodriguez
*Assistant Examiner* — Rodolphe Andre Chabreyrie
(74) *Attorney, Agent, or Firm* — Dority & Manning, P.A.

(57) ABSTRACT

A combustion liner assembly includes a combustion liner having an upstream end portion and a downstream end portion and a resonator disposed proximate to the upstream end portion of the combustion liner. The resonator includes a plurality of circumferentially spaced inlet apertures disposed along a radially outer surface of the resonator, an air chamber defined within the resonator and a plurality of outlet apertures disposed along a radially inner surface of the resonator. The plurality of inlet apertures provide for fluid flow into the air chamber and the plurality of outlet apertures provide for fluid flow out of the air chamber and into a radial flow passage defined within the combustor.

9 Claims, 7 Drawing Sheets

(52) U.S. Cl.
CPC ..... *F23R 3/28* (2013.01); *F23R 3/44* (2013.01); *F05D 2260/963* (2013.01); *F05D 2270/14* (2013.01); *F23R 2900/00014* (2013.01)

(58) Field of Classification Search
CPC ..... F05D 2260/962; F05D 2260/964; F05D 2240/35; F05D 2220/32
See application file for complete search history.

(56) References Cited

U.S. PATENT DOCUMENTS

| | | | | |
|---|---|---|---|---|
| 8,061,141 | B2 | 11/2011 | Johnson et al. | |
| 2008/0041058 | A1* | 2/2008 | Johnson | F23R 3/286 60/725 |
| 2008/0053107 | A1* | 3/2008 | Weaver | F01D 9/023 60/800 |
| 2011/0179795 | A1 | 7/2011 | Johnson et al. | |
| 2012/0102963 | A1 | 5/2012 | Corr et al. | |
| 2013/0042627 | A1* | 2/2013 | Gerendas | F23R 3/10 60/782 |
| 2013/0074471 | A1 | 3/2013 | Khan et al. | |
| 2013/0291543 | A1 | 11/2013 | Kim et al. | |
| 2014/0238029 | A1* | 8/2014 | Sutcu | F23R 3/10 60/754 |
| 2015/0113990 | A1* | 4/2015 | Eroglu | F23R 3/50 60/725 |
| 2015/0241062 | A1* | 8/2015 | Harding | B22F 3/1055 60/752 |
| 2018/0112875 | A1 | 4/2018 | Daniel | |
| 2018/0119958 | A1 | 5/2018 | Hoffman et al. | |

* cited by examiner

COMBUSTION DYNAMICS MITIGATION SYSTEM

FIELD OF THE TECHNOLOGY

The present invention generally involves a combustor for a gas turbine. More specifically, the invention relates to a combustion dynamics mitigation system for the combustor.

BACKGROUND

Particular combustion systems for gas turbine engines utilize combustors which burn a gaseous or liquid fuel mixed with compressed air. Generally, a combustor includes a fuel nozzle assembly including multiple fuel nozzles which extend downstream from an end cover of the combustor and which provide a mixture of fuel and compressed air to a primary combustion zone or chamber. A liner or sleeve circumferentially surrounds a portion of the fuel nozzle assembly and may at least partially define the primary combustion chamber. The liner may at least partially define a hot gas path for routing combustion gases from the primary combustion zone to an inlet of a turbine of the gas turbine.

In operation, compressed air flows through a premix or swozzle portion of each fuel nozzle. Fuel is injected into the compressed air flow and premixes with the compressed air before it is routed into the combustion chamber and burned to produce the combustion gases. During operation, various operating parameters such as fuel temperature, fuel composition, ambient operating conditions and/or operational load on the gas turbine may result in combustion dynamics or pressure pulses within the combustor. The combustion dynamics may cause oscillation of the various combustor hardware components such as the liner and/or the premix fuel nozzle which may result in undesirable wear of those components.

BRIEF DESCRIPTION OF THE TECHNOLOGY

Aspects and advantages are set forth below in the following description, or may be obvious from the description, or may be learned through practice.

One embodiment of the present disclosure is a combustion liner assembly. The combustion liner assembly includes a combustion liner having an upstream end portion and a downstream end portion and a resonator disposed proximate to the upstream end portion of the combustion liner. The resonator includes a plurality of circumferentially spaced inlet apertures disposed along a radially outer surface of the resonator, an air chamber defined within the resonator and a plurality of outlet apertures disposed along a radially inner surface of the resonator. The plurality of inlet apertures provide for fluid flow into the air chamber and the plurality of outlet apertures provide for fluid flow out of the air chamber and into a radial flow passage defined within the combustor.

Another embodiment of the present disclosure is a combustor. The combustor includes an outer casing defining a high pressure plenum therein, a bundled tube fuel nozzle having an outer sleeve and at least partially disposed within the high pressure plenum, a combustion liner having an upstream end portion that at least partially surrounds the outer sleeve of the bundled tube fuel nozzle and a resonator disposed proximate to the upstream end portion of the combustion liner. The resonator includes a plurality of circumferentially spaced inlet apertures disposed along a radially outer surface of the resonator, an air chamber defined within the resonator and a plurality of outlet apertures disposed along a radially inner surface of the resonator. The plurality of inlet apertures provide for fluid flow from the high pressure plenum into the air chamber and the plurality of outlet apertures provide for fluid flow out of the air chamber and into a radial flow passage defined within the combustor.

Those of ordinary skill in the art will better appreciate the features and aspects of such embodiments, and others, upon review of the specification.

BRIEF DESCRIPTION OF THE DRAWINGS

A full and enabling disclosure of the of various embodiments, including the best mode thereof to one skilled in the art, is set forth more particularly in the remainder of the specification, including reference to the accompanying figures, in which.

DETAILED DESCRIPTION

Figure 1:
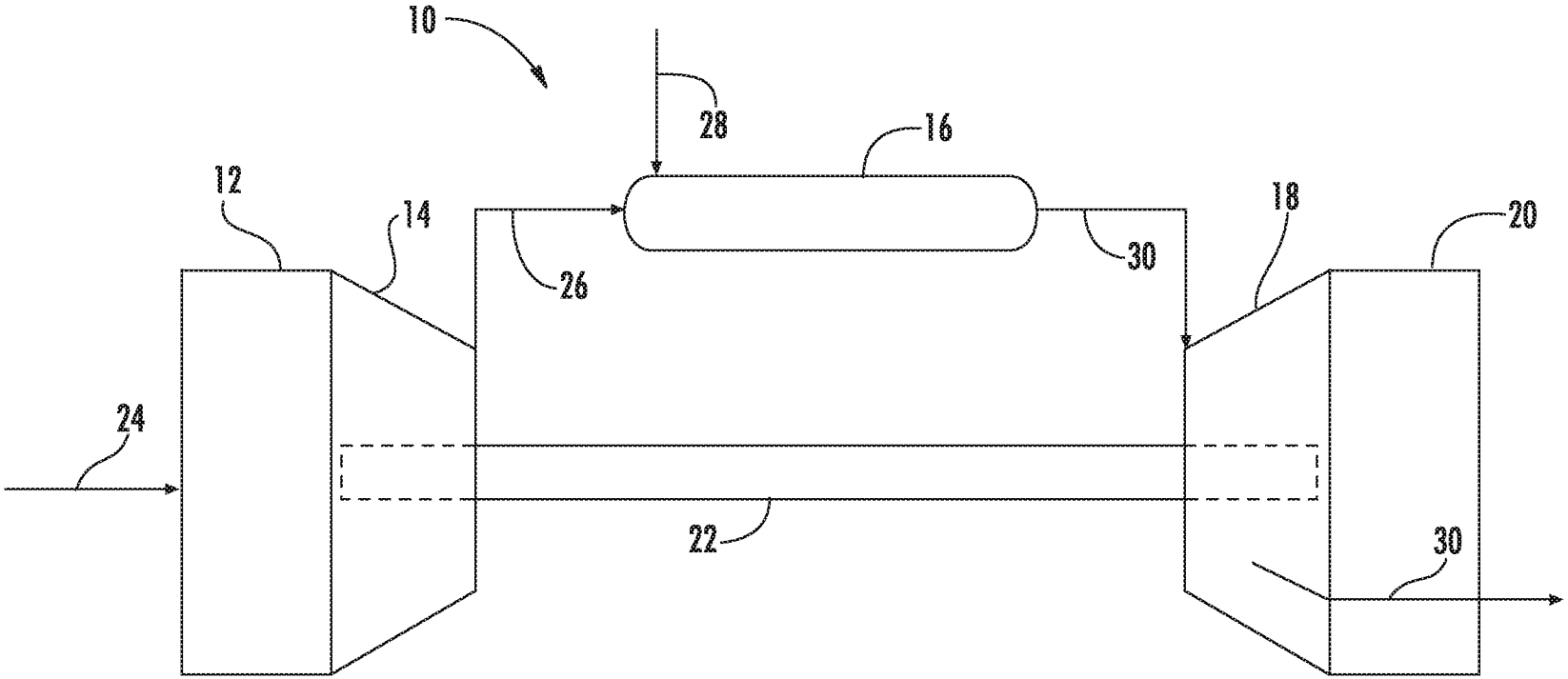
FIG. 1 is a functional block diagram of an exemplary gas turbine that may incorporate various embodiments of the present disclosure.

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, the term "axially" refers to the relative direction that is substantially parallel and/or coaxially aligned to an axial centerline of a particular component, and the term "circumferentially" refers to the relative direction that extends around the axial centerline of a particular component.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Each example is provided by way of explanation, not limitation. In fact, it will be apparent to those skilled in the art that modifications and variations can be made without departing from the scope or spirit thereof. For instance, features illustrated or described as part of one embodiment may be used on another embodiment to yield a still further embodiment. Thus, it is intended that the present disclosure covers such modifications and variations as come within the scope of the appended claims and their equivalents. Although exemplary embodiments of the present disclosure will be described generally in the context of a combustor for a land based power generating gas turbine for purposes of illustration, one of ordinary skill in the art will readily appreciate that embodiments of the present disclosure may be applied to any style or type of combustor for a turbomachine and are not limited to combustors or combustion systems for land based power generating gas turbines unless specifically recited in the claims.

Referring now to the drawings, FIG. 1 illustrates a schematic diagram of an exemplary gas turbine 10. The gas turbine 10 generally includes an inlet section 12, a compressor 14 disposed downstream of the inlet section 12, at least one combustor 16 disposed downstream of the compressor 14, a turbine 18 disposed downstream of the combustor 16 and an exhaust section 20 disposed downstream of the turbine 18. Additionally, the gas turbine 10 may include one or more shafts 22 that couple the compressor 14 to the turbine 18.

During operation, air 24 flows through the inlet section 12 and into the compressor 14 where the air 24 is progressively compressed, thus providing compressed air 26 to the combustor 16. At least a portion of the compressed air 26 is mixed with a fuel 28 within the combustor 16 and burned to produce combustion gases 30. The combustion gases 30 flow from the combustor 16 into the turbine 18, wherein energy (kinetic and/or thermal) is transferred from the combustion gases 30 to rotor blades (not shown), thus causing shaft 22 to rotate. The mechanical rotational energy may then be used for various purposes such as to power the compressor 14 and/or to generate electricity. The combustion gases 30 exiting the turbine 18 may then be exhausted from the gas turbine 10 via the exhaust section 20.

Figure 2:
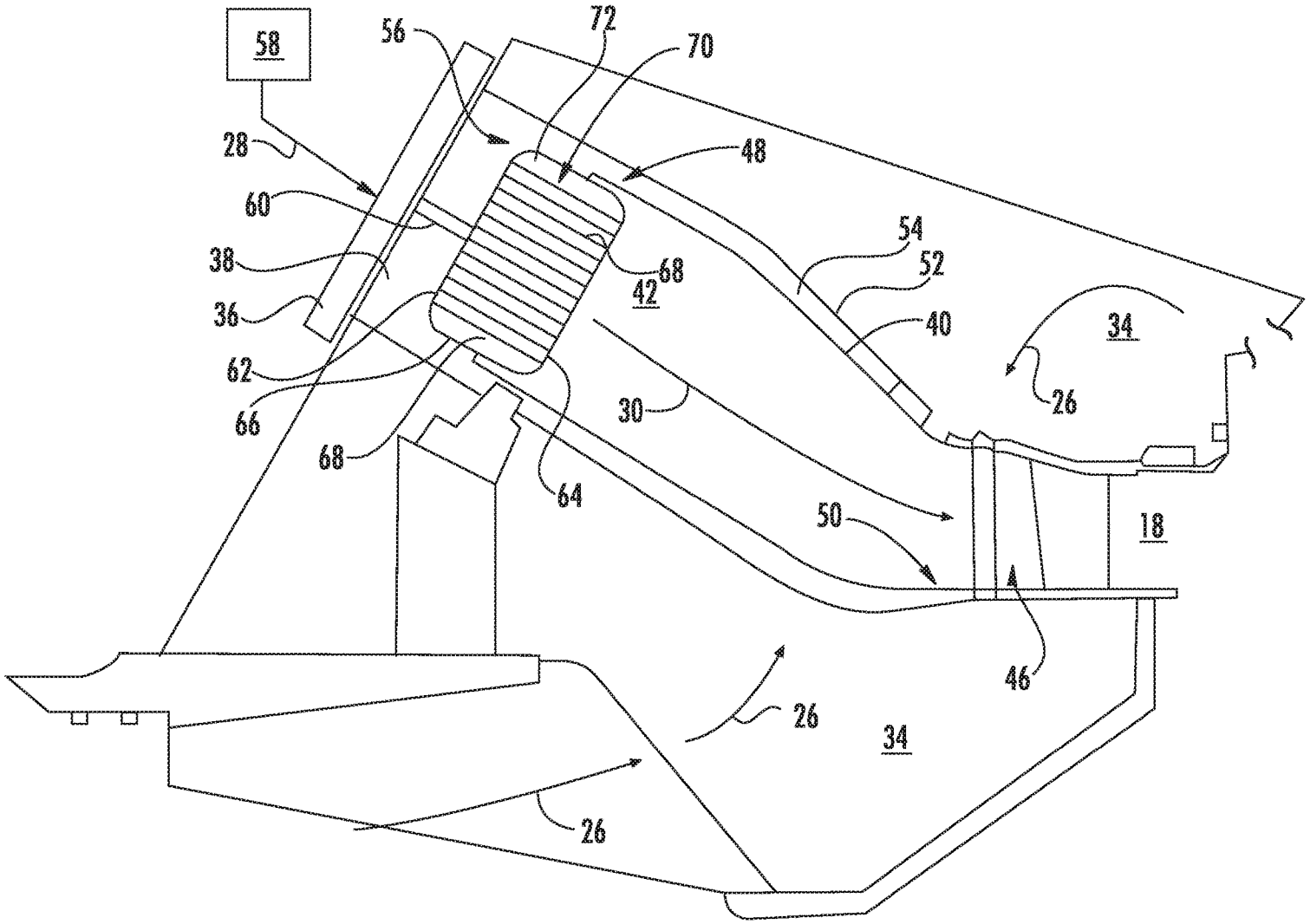
FIG. 2 is a simplified cross-section side view of an exemplary combustor as may incorporate various embodiments of the present disclosure.

As shown in FIG. 2, the combustor 16 may be at least partially surrounded by an outer casing 32 such as a compressor discharge casing. The outer casing 32 may at least partially define a high pressure plenum 34 that at least partially surrounds various components of the combustor 16. The high pressure plenum 34 may be in fluid communication with the compressor 14 (FIG. 1) so as to receive the compressed air 26 therefrom. An end cover 36 may be coupled to the outer casing 32. In particular embodiments, the outer casing 32 and the end cover 36 may at least partially define a head end volume or portion 38 of the combustor 16.

In particular embodiments, the head end portion 38 is in fluid communication with the high pressure plenum 34 and/or the compressor 14. One or more combustion liners or ducts 40 may at least partially define a combustion chamber or zone 42 for combusting the fuel-air mixture and/or may at least partially define a hot gas path 44 through the combustor for directing the combustion gases 30 towards an inlet 46 to the turbine 18. In particular embodiments, the combustion liner 40 is formed as or from a singular body or unibody such that an upstream end portion 48 of the combustion liner 40 is substantially cylindrical or round and defines the combustion zone 42. The combustion liner 40 then transitions to a non-circular or substantially rectangular cross sectional shape proximate to a downstream end portion 50 of the combustion liner 40.

In particular embodiments, the combustion liner 40 is at last partially circumferentially surrounded by a flow sleeve 52. The flow sleeve 52 may be formed as a single component or by multiple flow sleeve segments. The flow sleeve 52 is radially spaced from the combustion liner 40 so as to define a flow passage or annular flow passage 54 therebetween. The flow passage 54 provides for fluid communication between the high pressure plenum 34 and the head end 38 of the combustor.

In various embodiments, the combustor 16 includes at least one bundled tube fuel nozzle 56 or bundled tube fuel nozzle assembly. As shown in FIG. 2, the bundled tube fuel nozzle 56 is disposed within the outer casing 32 downstream from and/or axially spaced from the end cover 36 with respect to an axial centerline of the combustor 16 and upstream from the combustion chamber 42. In particular embodiments, the bundled tube fuel nozzle 56 is in fluid communication with a fuel supply 58 via one or more fluid conduits 60. In particular embodiments, the fluid conduit(s) 60 may be fluidly coupled and/or connected at one end to the end cover 36.

It should be understood that the bundled tube fuel nozzle 56 and/or the fluid conduit(s) 58 may be mounted to structures other than the end cover 36 (e.g., the outer casing 32). It is also to be understood that the combustor 16 may include other fuel nozzle types or fuel nozzle assemblies in addition to or in place of the bundled tube fuel nozzles and the disclosure is not limited to bundled tube fuel nozzles unless other recited in the claims.

Various embodiments of the combustor 16 may include different arrangements of the bundled tube fuel nozzle 56 and is not limited to any particular arrangement unless otherwise specified in the claims. In particular configurations the bundled tube fuel nozzle 56 may include multiple wedge shaped fuel nozzle segments annularly arranged about a common centerline. In some embodiments, as illustrated in FIG. 2, the bundled tube fuel nozzle 56 may include a circular or barrel shaped fuel nozzle segment centered along a centerline. In particular embodiments, the bundled tube fuel nozzle 56 may form an annulus or fuel nozzle passage about a center fuel nozzle (not shown).

In at least one embodiment, as shown in FIG. 2, the bundled tube fuel nozzle 56 includes a forward or upstream plate 62, an aft or downstream plate 64 axially spaced from the forward plate 62 and an outer band or sleeve 66 that extends axially between the forward plate 62 and the aft plate 64. In particular embodiments, the forward plate 62, the aft plate 64 and the outer sleeve 66 may at least partially define a fuel plenum 68 within the bundled tube fuel nozzle 56. In particular embodiments, fluid conduit 60 may extend through the forward plate 58 to provide fuel 28 to the fuel plenum 68.

In various embodiments, the bundled tube fuel nozzle 56 includes a tube bundle 70 comprising a plurality of tubes 72. Each tube 72 extends through the forward plate 62, the fuel plenum 68 and the aft plate 64 and each tube 72 defines a respective premix flow passage through the bundled tube fuel nozzle 56 for premixing the fuel 28 with the compressed air 26 within each tube 72 before it is directed into the combustion zone 42. In particular embodiments, one or more tubes 72 of the plurality of tubes 72 is in fluid communication with the fuel plenum 68 via one or more fuel ports (not shown) defined within the respective tube(s) 68.

Figure 3:
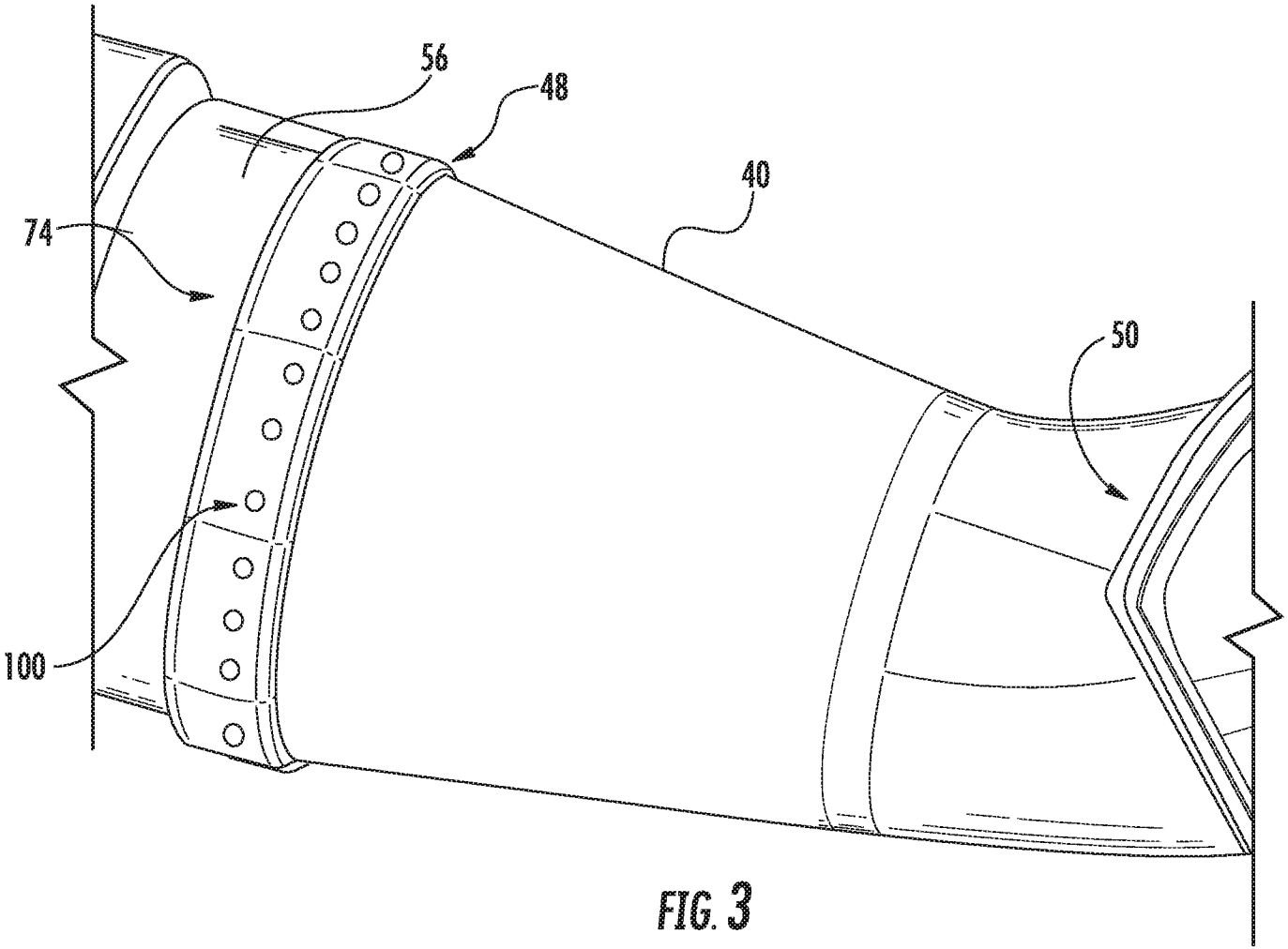
FIG. 3 is a perspective view of a portion of an exemplary combustion liner and an exemplary bundled tube fuel nozzle according to at least one embodiment of the present disclosure.

FIG. 3 provides a perspective view of a portion of the combustion liner 40 and the bundled tube fuel nozzle 56 according to at least one embodiment of the present disclosure. In various embodiments, as shown in FIG. 3, an aft end portion 74 of the bundled tube fuel nozzle 56 extends axially into the upstream end portion 48 of the combustion liner 40. A resonator 100 is disposed proximate to the upstream end portion 48 of the combustion liner 40. In particular embodiments, the resonator 100 extends at least partially circumferentially around the combustion liner 40 proximate to the upstream end portion 48 of the combustion liner 40. In particular embodiments, the resonator 100 may at least partially define the upstream end portion 48 of the combustion liner 40. The resonator 100 may be formed as a continuous body or may be divided into multiple arcuate segments.

Figure 4:
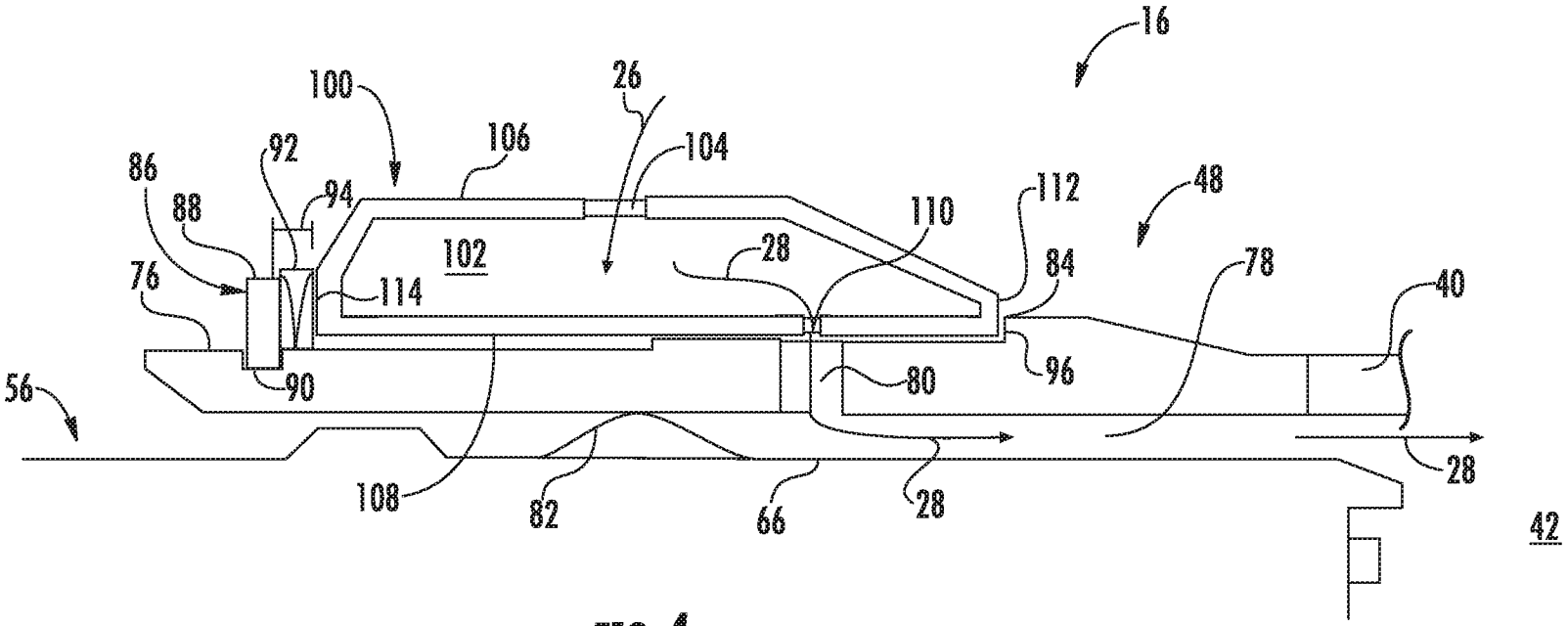
FIG. 4 is an enlarged cross sectional side view of a portion of an exemplary combustor including a portion of a bundled tube fuel nozzle, a portion of an exemplary combustion liner and an exemplary resonator according to at least one embodiment of the present disclosure.
Figure 5:
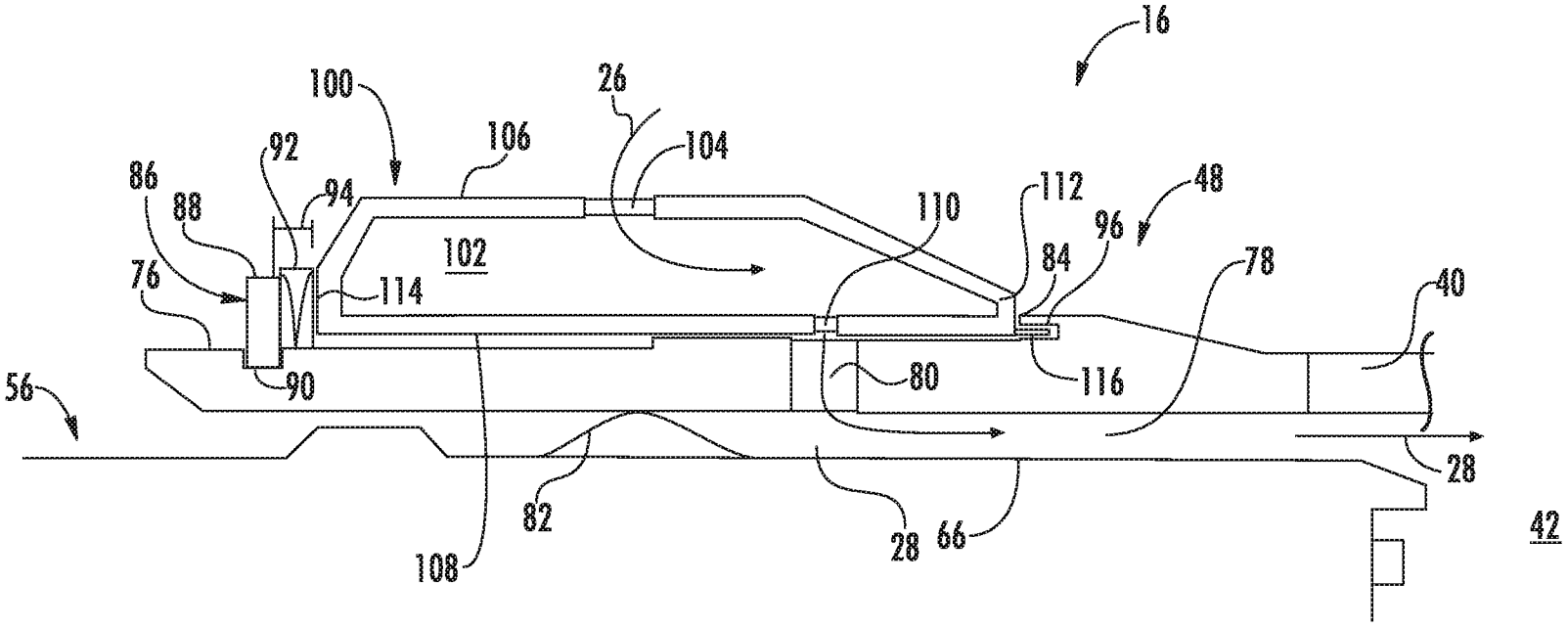
FIG. 5 is an enlarged cross sectional side view of a portion of an exemplary combustor including a portion of a bundled tube fuel nozzle, a portion of an exemplary combustion liner and an exemplary resonator according to at least one embodiment of the present disclosure.
Figure 6:
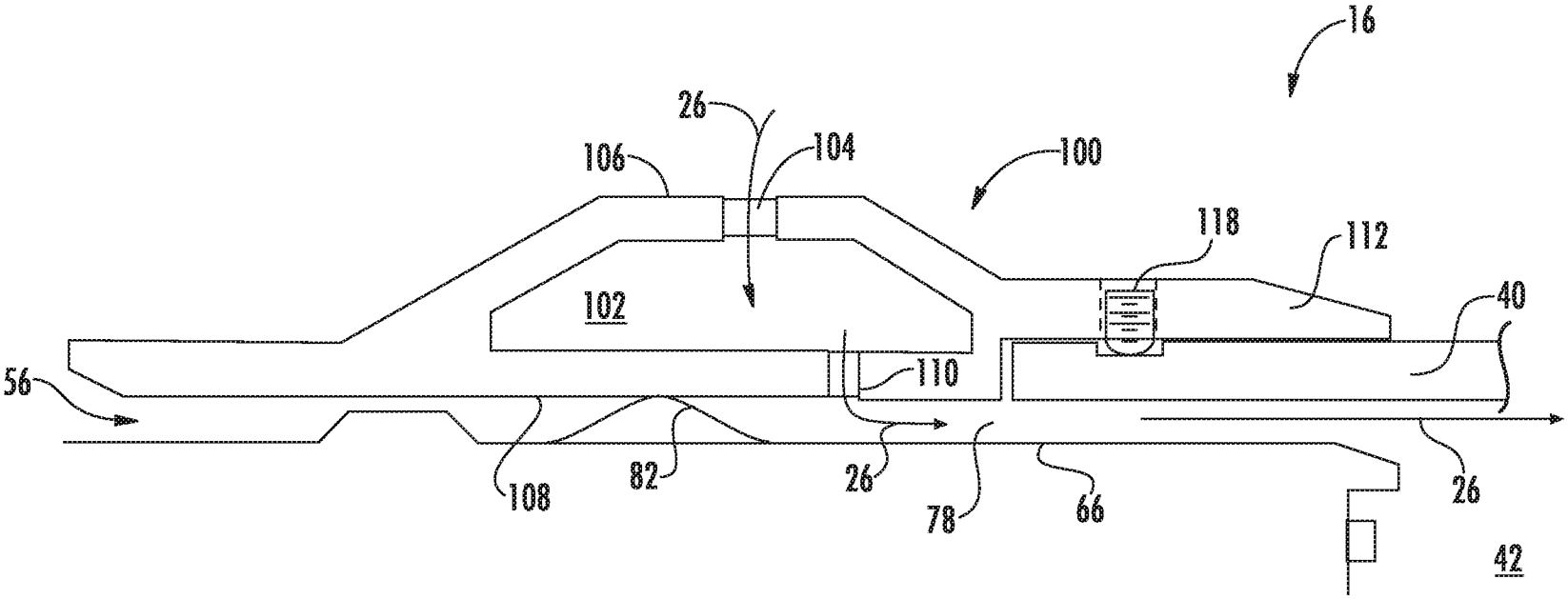
FIG. 6 is an enlarged cross sectional side view of a portion of an exemplary combustor including a portion of a bundled tube fuel nozzle, a portion of an exemplary combustion liner and an exemplary resonator according to at least one embodiment of the present disclosure.
Figure 7:
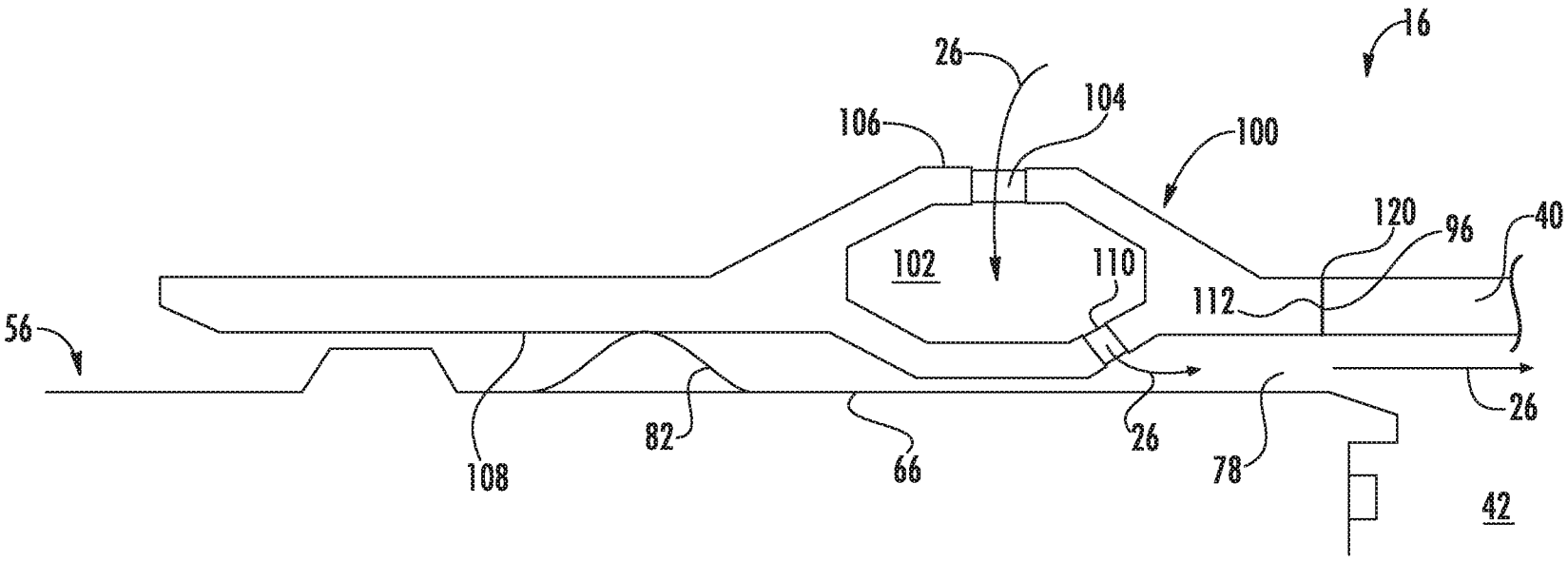
FIG. 7 is an enlarged cross sectional side view of a portion of an exemplary combustor including a portion of a bundled tube fuel nozzle, a portion of an exemplary combustion liner and an exemplary resonator according to at least one embodiment of the present disclosure.

FIG. 4 provides an enlarged cross sectional side view of a portion of the combustor 16 including a portion of the bundled tube fuel nozzle 56, a portion of the upstream end portion 48 of the combustion liner 40 and the resonator 100 according to at least one embodiment of the present disclosure. FIG. 5 provides an enlarged cross sectional side view of a portion of the combustor 16 including a portion of the bundled tube fuel nozzle 56, a portion of the upstream end portion 48 of the combustion liner 40 and the resonator 100 according to at least one embodiment of the present disclosure. FIG. 6 provides an enlarged cross sectional side view of a portion of the combustor 16 including a portion of the bundled tube fuel nozzle 56, a portion of the upstream end portion 48 of the combustion liner 40 and the resonator 100 according to at least one embodiment of the present disclosure. FIG. 7 provides an enlarged cross sectional side view of a portion of the combustor 16 including a portion of the bundled tube fuel nozzle 56, a portion of the upstream end portion 48 of the combustion liner 40 and the resonator 100 according to at least one embodiment of the present disclosure.

The resonator 100 may be formed as a continuous body or may be divided into multiple segments. In various embodiments, as shown in FIG. 4 through 7, the resonator 100 includes or defines an air chamber or void 102 therein. A plurality of inlet apertures 104 may be defined along an outer or radially outer surface or side 106 of the resonator 100. The plurality of inlet apertures 104 provide for fluid communication into the air chamber 102. For example, the plurality of inlet apertures 102 may provide for fluid communication between the high pressure plenum 34 (FIG. 2) and/or the flow passage 54 (FIG. 2) and the air chamber 102 during operation of the combustor 16.

The relative dimensions and location of the inlet apertures 104 and/or the volume of the air chamber 102 may be specified based at least in part on particular frequencies to be addressed within the combustor 16. For example, the inlet apertures 104 and/or or inner walls of the resonator defining the air chamber 102 may be oblique and/or tapered, concave, convex, etc.

In particular embodiments, as shown in FIGS. 4 through 7, the resonator 100 may further define and/or include an inner or radially inner surface 108. In particular embodiments as shown in FIGS. 4 and 5, the inner surface 108 of the resonator 100 is oriented towards, faces or is adjacent to an outer surface 76 of the combustion liner 40. In other embodiments as shown in FIGS. 6 and 7, the inner surface 108 of the resonator 100 is oriented towards, faces and/or is adjacent to the outer sleeve 66 of the bundled tube fuel nozzle 56.

In particular embodiments, as shown in FIGS. 4 through 7, the resonator 100 may include and/or define a plurality of outlet apertures 110 disposed along the inner surface 108 of the resonator 100. One or more of the outlet apertures 110 may provide for fluid communication out of the air chamber 102 and into a radial flow passage 78. The radial flow passage 78 may be in fluid communication with the combustion chamber 42.

In particular embodiments as shown in FIGS. 4 and 5, the radial flow passage 78 may be at least partially defined between the combustion liner 40 and the outer sleeve 66 of the bundled tube fuel nozzle 56. In particular embodiments as shown in FIGS. 6 and 7, the radial flow passage 78 may be at least partially defined between the radially inner surface 108 of the resonator 100 and the outer sleeve 66 of the bundled tube fuel nozzle 56.

In particular embodiments, as shown in FIGS. 4 and 5, the combustion liner 40 may define and/or include a plurality of holes or openings 80. The holes 80 may at least partially align with one or more of the outlet apertures 110 so as to provide for fluid communication from the air chamber 102, through the outlet apertures 110, through the combustion liner 40 and into the radial flow passage 78. In particular embodiments, as shown in FIGS. 4 and 5, at least one radial seal 82 such as a spring or hula seal may be disposed radially between the outer sleeve 66 of the bundled tube fuel nozzle 56 and the combustion liner 40. The radial seal 82 may be positioned axially forward of one or more of the holes 80 of the combustion liner 40 with respect to an axial centerline of the combustor 16.

In particular embodiments, as shown in FIGS. 6 and 7, the radial seal 82 may be positioned axially forward of one or more of the outlet apertures 110 of the resonator 100 between the resonator 100 and the outer sleeve 66 of the bundled tube fuel nozzle 56.

In operation, compressed air 26 from the high pressure plenum 34 (FIG. 2) flows into the air chamber 102 via the inlet apertures 104. The compressed air 26 then flows into the radial flow passage 78 via the outlet apertures 110 and the holes 80 defined by the combustion liner 40 when present. The compressed air may then be routed from the radial flow passage 78 to the combustion chamber 42. The radial seal 82 may limit the amount of compressed air flowing to or prevent the compressed air from flowing into the head end volume 38 of the combustor 16 from the radial flow passage 78.

The resonator 100 may be attached to the combustion liner 40 via various attaching means. For example, in particular embodiments, as shown in FIGS. 4 and 5, the resonator 100 may be at least partially attached or held in place via spring force. As shown in FIG. 4, an aft wall or portion 112 of the resonator 100 may be seated or loaded against a step wall or lip 84 disposed on and/or formed along the outer surface 76 of the combustion liner 40. A forward stop or radial projection 86 extends radially outwardly from the outer surface 76 of the liner 40 and is disposed or defined axially forward from a forward wall or surface 114 of the resonator 100. In particular embodiments, the radial projection 86 is defined by a snap ring 88. The snap ring 88 may be seated or at least partially disposed within a forward slot 90 defined by and/or along the outer surface 76 of the combustion liner 40. The snap ring 88 extends at least partially circumferentially around the combustion liner 40.

A spring 92 such as a wave spring or compression spring is disposed within a spring gap 94 defined between the radial projection 86 and the forward wall 114 of the resonator 100. The spring 92 provides an axial spring force sufficient to load the aft wall 112 of the resonator 100 against the step wall or lip 84 of the combustion liner 40 and to hold the resonator 100 in position during operation of the gas turbine 10.

In particular embodiments as illustrated in FIG. 5, the aft wall 112 of the resonator 100 includes an axial projection 116. The axial projection 116 may extend into a notch or groove 96 formed in the step wall or lip 84 of the combustion liner 40. The axial projection 116 may prevent or limit radial movement of the resonator 100 during operation of the gas turbine 10 and/or during instillation of the resonator 100 onto the combustion liner 40. In particular embodiments, as shown collectively in FIGS. 4 and 5, a seal 98 may be disposed between the outer surface 76 of the combustion liner 40 and the inner surface 108 of the resonator 100. The seal 98 may be positioned axially forward of one or more of the outlet apertures 110.

In at least one embodiment, as shown in FIG. 6, the resonator 100 may be at least partially attached or held in place via a mechanical fastener 118 such as a bolt or set screw. The mechanical fastener 118 may extend through a portion of the resonator 100 and may be threaded into the combustion liner 40, thereby securing the resonator 100 in place. In one embodiment, as shown in FIG. 7, a weld joint 120 may be formed between the resonator 100 and the combustion liner 40, thereby securing the resonator 100 in place.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A combustion liner assembly, comprising:

a combustion liner having an upstream end portion and a downstream end portion; and a resonator disposed proximate to the upstream end portion of the combustion liner, the resonator including a plurality of circumferentially spaced inlet apertures disposed along a radially outer surface of the resonator, an air chamber defined within the resonator, and a plurality of outlet apertures disposed along a radially inner surface of the resonator, wherein the plurality of circumferential spaced inlet apertures provide for fluid flow into the air chamber and the plurality of outlet apertures provide for fluid flow out of the air chamber and into a radial flow passage defined within a combustor, the resonator extends at least partially circumferentially around an outer surface of the upstream end portion of the combustion liner, the combustor further comprising a radial projection that extends radially outwardly from the outer surface of the combustion liner, the combustion liner includes a step wall axially spaced from the radial projection, the resonator is disposed between the radial projection and the step wall, wherein an aft wall of the resonator defines an axial projection and the step wall of the liner defines a notch disposed within the step wall, and the axial projection extends into the notch.

2. The combustion liner assembly as in claim 1, wherein the liner defines a plurality of holes in fluid communication with the plurality of outlet apertures, wherein each hole of the plurality of holes is in fluid communication with the radial flow passage.

3. The combustion liner assembly as in claim 1, further comprising a spring disposed between the radial projection and a forward wall of the resonator, wherein the spring pushes axially against the resonator so as to load the aft wall of the resonator against the step wall.

4. The combustion liner assembly as in claim 1, wherein a forward wall comprises a snap ring at least partially disposed within a forward slot defined by combustion liner.

5. A combustor, comprising:

an outer casing defining a high pressure plenum therein;

a fuel nozzle having an outer sleeve and at least partially disposed within the high pressure plenum;

a combustion liner having an upstream end portion that at least partially surrounds the outer sleeve of the fuel nozzle; and a resonator disposed proximate to the upstream end portion of the combustion liner, the resonator including a plurality of circumferentially spaced inlet apertures disposed along a radially outer surface of the resonator, an air chamber defined within the resonator, and a plurality of outlet apertures disposed along a radially inner surface of the resonator, wherein the plurality of inlet circumferentially spaced apertures provide for fluid flow from the high pressure plenum into the air chamber and the plurality of outlet apertures provide for fluid flow out of the air chamber and into a radial flow passage defined within the combustor, the resonator extends at least partially circumferentially around an outer surface of the upstream end portion of the combustion liner, the combustor including a radial projection that extends radially outwardly from the outer surface of the combustion liner, the combustion liner including a step wall axially spaced from the radial projection, wherein the resonator is disposed between the radial projection and the step wall, the combustor further including a spring disposed between the radial projection and a forward wall of the resonator, wherein the spring pushes axially against the resonator so as to load the resonator against the step wall, wherein an aft wall of the resonator defines an axial projection and the step wall of the liner defines a notch disposed within the step wall, wherein the axial projection extends into the notch.

6. The combustor as in claim 5, wherein the radial flow passage is defined between the outer sleeve of the fuel nozzle and at least one of the combustion liner and the radially inner surface of the resonator.

7. The combustor as in claim 5, wherein the radial flow passage is in fluid communication with a combustion chamber at least partially defined by the combustion liner downstream from the fuel nozzle.

8. The combustor as in claim 5, wherein the liner defines a plurality of holes in fluid communication with the plurality of outlet apertures, wherein each hole of the plurality of holes is are in fluid communication with the radial flow passage.

9. The combustor as in claim 5, wherein the radial projection comprises a snap ring at least partially disposed within a forward slot defined by the combustion liner.

* * * * *